United States Patent [19]

Brooke

[11] 4,020,788

[45] May 3, 1977

[54] DOCTORING MEANS

[75] Inventor: Edric R. Brooke, Welwyn Garden City, England

[73] Assignee: Xerox Corporation, Stamford, Conn.

[22] Filed: Oct. 22, 1975

[21] Appl. No.: 624,628

[30] Foreign Application Priority Data

Nov. 20, 1974 United Kingdom ..... 50314/74

[52] U.S. Cl. ..... 118/7; 118/261; 118/DIG. 23

[51] Int. Cl.[2] ..... B05C 1/00; B05C 11/04

[58] Field of Search ..... 118/7, 637, 261, 8, 118/DIG. 23; 101/350

[56] References Cited

UNITED STATES PATENTS 3,667,428 6/1972 Smith ..... 118/261 X 3,888,173 6/1975 Ritzerfeld ..... 101/350

FOREIGN PATENTS OR APPLICATIONS 1,163,650 2/1964 Germany ..... 118/410

*Primary Examiner*—John P. McIntosh

*Attorney, Agent, or Firm*—James J. Ralabate; Ernest F. Chapman

[57] ABSTRACT

An apparatus controls the pressure of a doctoring means against an applicator surface to compensate for charges in the ambient temperature. The apparatus comprises a set of jaws which bring the doctoring means to pressure contact with the applicator surface upon closing and a means for limiting the closing of the jaws at lower temperatures to provide doctoring under reduced pressure at lower temperatures.

10 Claims, 4 Drawing Figures

FIG. 3
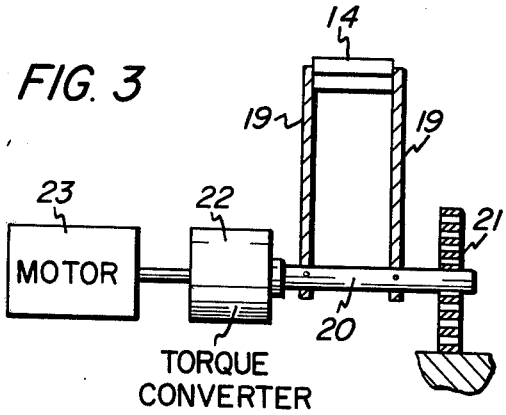
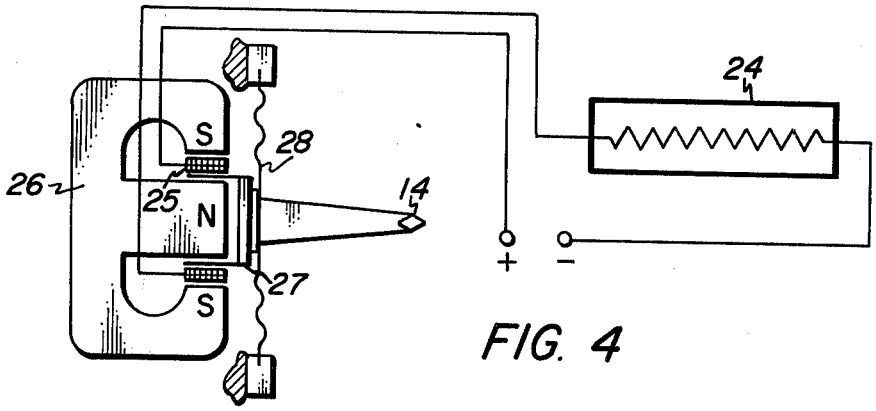
FIG. 4

DOCTORING MEANS

BACKGROUND OF THE INVENTION

This invention relates to imaging systems, and more particularly, to improved developer systems and techniques.

The formation and development of images on the surface of photoconductive materials by electrostatic means is well known. The basic electrostatographic process, as taught by C. F. Carlson in U.S. Pat. No. 2,297,691 involves placing a uniform electrostatic charge on a photoconductive insulating layer, exposing the layer to a light-and-shadow image to dissipate the charge on the areas of the layer exposed to the light and developing the resulting charge pattern by depositing on the layer a finely-divided marking material referred to in the art as "toner". The toner will normally be attracted to those areas of the layer which retain a charge, thereby forming a toner image corresponding to the charge pattern. This powder image may then be transferred to a support surface such as paper. The transferred image may subsequently be permanently affixed to a support surface as by heat.

Instead of charge pattern formation by uniformly charging the photoconductive layer and then exposing the layer to a light-and-shadow image, one may form the charge pattern by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Similar methods are known for applying the marking particles to the electrostatic latent image to be developed. Included within this group are the "cascade" development technique disclosed by E. N. Wise in U.S. Pat. No. 2,618,552, the "powder cloud" technique disclosed by C. F. Carlson in U.S. Pat. No. 2,221,776 and the "magnetic brush" process disclosed, for example, in U.S. Pat. No. 2,874,063.

Development of a charge pattern may also be achieved with liquid rather than dry developer materials. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern the suspended particles migrate toward the charged portions of the imaging surface separating out of the insulating liquid. This electrophoretic migration of charged particles results in the deposition of the charged particles on the imaging surface in image configuration.

An additional development technique is that referred to as "wetting development" described in U.S. Pat. No. 3,285,741. In this technique an aqueous developer uniformly contacts the entire imaging surface and due to the selected wetting and electrical properties of the developer substantially only the charged areas of the imaging surface are wetted by the developer. The developer should be relatively conductive having a resistivity generally from about $10^6$ to $10^{10}$ ohm cm and having wetting properties such that the wetting angle measured when placed on the photoconductor surface is amaller than 90° at the charged areas and greater than 90° in the uncharged areas.

A significant advance in developing charge patterns in a liquid development process is disclosed by R. W. Gundlach in U.S. Pat. No. 3,084,043. In this method hereinafter referred to as polar liquid development, a charge pattern is developed or made visible by presenting to the image surface a liquid developer on the surface of a developer dispensing member having a plurality of raised portions or "lands" defining a substantially regular patterned surface and a plurality of portions depressed below the raised portions or "valleys". The depressed portions of the developer dispensing member contain a layer of conductive liquid developer which is maintained out of contact with the electrostatographic imaging surface.

Development is achieved by moving the developer dispensing member loaded with liquid developer in the depressed portions into developing configuration with the imaging surface. The liquid developer is believed to be attracted from the depressed portions of the applicator surface in the charged or image areas only. The developer liquid may be pigmented or dyed.

The development system disclosed in U.S. Pat. No. 3,084,043 differs from electrophoretic development systems where a substantial contact between the liquid developer and both the charged and uncharged areas of an image bearing surface occurs. Unlike electrophoretic development systems, substantial contact between the polar liquid and the areas of the electrostatic latent image bearing surface not to be developed is prevented in the polar liquid development technique. Reduced contact between a liquid developer and the non-imaging areas of the surface to be developed is desirable because the formation of background deposits is thereby inhibited. Another characteristic which distinguishes the polar liquid development from electrophoretic development is the fact that the liquid phase of a polar developer actually takes part in the development of a surface. The liquid phase in electrophoretic developers functions only as a carrier medium for developer particles.

In the development system disclosed in U.S. Pat. No. 3,084,043 an applicator roll is utilized to present liquid developer to the surface of the member carrying the charge pattern. The amount of liquid on the applicator roll is carefully controlled by using a doctoring or metering blade. It has been found that this system that the quality of the final images produced may depend greatly on the temperature of the liquid developer in the system. It has been observed that with many liquid developers variation in temperature causes a viscosity change which effects the final developed image density. In general at higher operating temperatures the reproduced images are more dense than at lower operating temperatures. This result can be explained when it is realized that at higher operating temperatures the liquid often becomes less viscous and thus more readily transferable at the image developing station. Accordingly, to provide uniform results at an operating temperature of 10° and 40° C where the viscosity change can be as much as ten-fold requires a system for temperature compensation.

Prior art processes have attempted to solve this problem by using viscosity controlling additives, but such additives have not proved to be totally successful. Moreover, the difficulties associated with changes in temperature are not limited solely to the changing viscosity of the liquid developer. For example, where a resilient thermoplastic doctoring blade is used to meter or control the loading of the liquid developer on the applicating member, the changes in temperature may effect the viscoelastic properties of the blade material which, in turn, may result in different doctoring depths. Therefore, even where the viscosity of the liquid developer is being controlled, changes in ambient temperature may still result in inconsistent and poor image quality.

An apparatus and process for temperature compensation in liquid developing compositions have been provided by S. C. P. Hwa in U.S. Ser. No. 552,234 filed Feb. 24, 1975 and assigned to the instant assignee. Hwa describes an apparatus for doctoring having means for automatically adjusting the pressure of the doctoring means against an applicator in response to changes in ambient temperature. Exemplary of such adjusting means are thermo-mechanical devices, thermo-electromic devices and thermo-fluidic devices.

SUMMARY OF THE INVENTION

It is a primary object of this invention to provide a specific apparatus for controlling the pressure of a doctoring means against a surface to be doctored wherein the apparatus is responsive to changes in the ambient temperature.

These and other objects of the invention are accomplished by providing an apparatus for controlling the pressure of a doctoring means against a surface to be doctored wherein the apparatus is responsive to changes in the ambient temperature, which comprises:

a. a set of jaws wherein one of said jaws is stationary and another of said jaws is connected to extendable linkages to said doctoring means and to a means for repeatedly moving said jaws to a closed position, said movement being effective to bring the doctoring means into pressure contact with the surface sought to be doctored, and b. a means for limiting the closing of the jaws responsive to ambient temperature such that the pressure of the doctoring means against the surface sought to be doctored is decreased at a lower temperature and increased at a higher temperature. The apparatus of this invention is particularly suitable for the liquid development of charge patterns formed on the surface of a photoconductive member such as described in U.S. Pat. No. 3,084,043 and U.S. Pat. No. 3,806,354, both patents being incorporated herein by reference.

Using the development techniques described in U.S. Pat. No. 3,084,043 and U.S. Pat. No. 3,806,354, liquid developer is suitably applied to an applicator roll in excess of requirements and the surface of the roll is engaged by a blade prior to arrival at the photoreceptor to meter or doctor the amount of liquid on the roll surface so as at least substantially to remove all liquid from the lands and to reduce the level of the liquid in the valleys to below the level of the lands.

Typically, the grooves of the applicator roll are about 60 microns deep with their centers across the lands about 100 microns apart. For such application the blade is suitably made of a flexible plastic or elastomeric material such as polyurethane or neoprene and has a rectangular front edge maintained in pressure engagement with the roll surface during operation at a trailing angle with respect to the direction of movement of the applicator roll. It has been found that for uniform doctoring or metering of the liquid developer on the applicator roll, the blade material should preferably have a durometer Shore hardness of between about 60 and about 90, and the blade angle should be maintained within close limits. For example, a 3.15 mm thick doctor blade of durometer Shore hardness $75 \pm 5$, acting on a 25 mm diameter applicator roller is maintained at an angle to the tangent to the roll surface at the line of engagement of the blade with the tangent of $48° \pm 1°$ and is loaded at a pressure variable between about 60 gm per cm length and 180 gm per cm length.

To provide temperature compensation of these pressures in accordance with the present invention a set of jaws is placed in the linkage used for repeatedly camming the doctoring means against the liquid developer applicator roller, and a means for limiting the closing of the jaws responsive to ambient temperature is provided.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIG. 3 is a schematic illustration of a fluid torque converter means for limiting the closing of the jaws.

FIG. 4 is a schematic illustration of diaphragm means responsive to an electrical resistor sensor for limiting the closing of the jaws.

DESCRIPTION OF THE PREFERRED EMBODIMENTS

Figure 1:
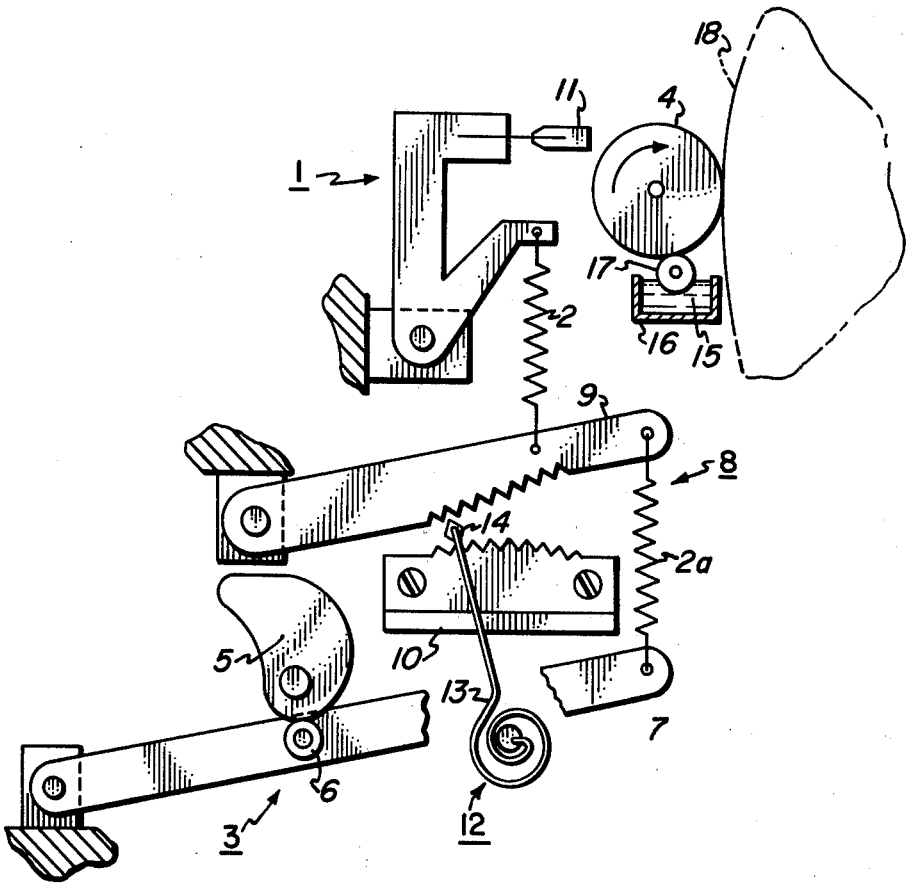
FIG. 1 is schematic illustration of one embodiment of the present invention showing limiting means as a bimetal strip which supports an interposer means between the set of jaws, the blade being in a disengaged mode.

Referring now to FIG. 1 there is shown schematically and in cross-section an apparatus for controlling the pressure of a doctoring means against a liquid developer applicator roller 4, such as a gravure roll, responsive to ambient temperature. Doctoring means or assembly generally designated 1 is connected by extendable linkages 2 and **2*a* to a means or assembly generally designated 3, for repeatedly camming the doctoring means 1 to engage doctor blade 11 against the liquid developer applicator roller 4. The camming means or assembly 3 includes a shaft driven cam 5 which operates against cam follower 6 to move the cam follower bar 7 so as to urge the extendable linkage 2*a***.

Extendable linkage 2 and **2*a* are both connected to movable jaw 9 of a set of jaws which is generally designated 8. Stationary jaw 10 is positioned so that as the cam follower bar 7 moves the extendable linkage 2*a*, the movable jaw 9 is drawn toward the stationary jaw 10 to close the jaws 8. Extendable linkage 2, which is also connected to the movable jaw 9, is thus moved so as to bring the doctor blade 11 of doctoring means 1 into functional contact with the liquid developer applicator roller 4**.

In the exemplary doctoring means or assembly 1 depicted in FIG. 1, the doctor blade 11 is a neoprene member shaped to have a generally rectangular front edge and a thickness of about 3.15 mm and a hardness of about 75° (Shore A durometer). It is preferably positioned to contact the liquid developer applicator roller 4 at an angle of about 48° to the tangent to the roller 4 surface at the line of engagement of the blade with the tangent when the means for camming 3 is actuated.

The exemplary limiting means 12 (for limiting the closing of the jaws) of FIG. 1 is a bimetal strip 13 which supports an interposer means 14 between the members of the set of jaws 8. The bimetal strip moves the interposed means 14 to different positions between the members of the set of jaws 8 depending on the ambient temperature. The closing of the jaws is thus limited to varying degrees depending upon the ambient temperature. At colder ambient temperatures the interposer 14 will move so as to more severely limit the closing of the set of jaws 8. At higher temperatures, the interposer 14 will be moved to allow the set of jaws 8 to close further. One skilled in the art may provide conventional bimetal strip materials for the apparatus of this invention.

The movement of the movable jaw 9 is transmitted through the extendable linkage 2 to the doctoring means 1 to bring the doctor blade 11 to bear against the liquid developer applicator roller 4. In a working example, the extendable linkage 2 is selected to cooperate with the position of the interposer 14 so as to provide a doctoring load between the doctor blade 11 and the liquid developer applicator roller 4 of from about 27 gm/cm at about 12° C to about 310 gm/cm at about 35° C. Such a loading compensates for the changes in viscosity of a typical mineral oil based liquid developer sufficiently to accomplish substantially similar doctoring of the liquid developer applicator roller at temperatures between about 12° and about 35° C at which the typical viscosity may range from about 1800 to about 300 cps respectively.

As shown in FIG. 1, the liquid developer 15 is maintained in container 16 so as to wet loading roller or rolling train roller 17 which applies a coating of liquid developer 15 to both the lands (not shown) and valleys (not shown) of the applicator roller 4. The applicator roller 4 then rotates past the doctoring means 1 where the doctor blade 11 doctors or wipes clean the lands and leaves a desirable amount of liquid developer in the valleys of the applicator roller 4. The applicator roller then rotates in contacting cooperation with the imaging member 18 whereupon a charge pattern may be developed by the liquid developer in accordance with the teachings of U.S. Pat. No. 3,084,043 and U.S. Pat. No. 3,806,354.

Figure 2:
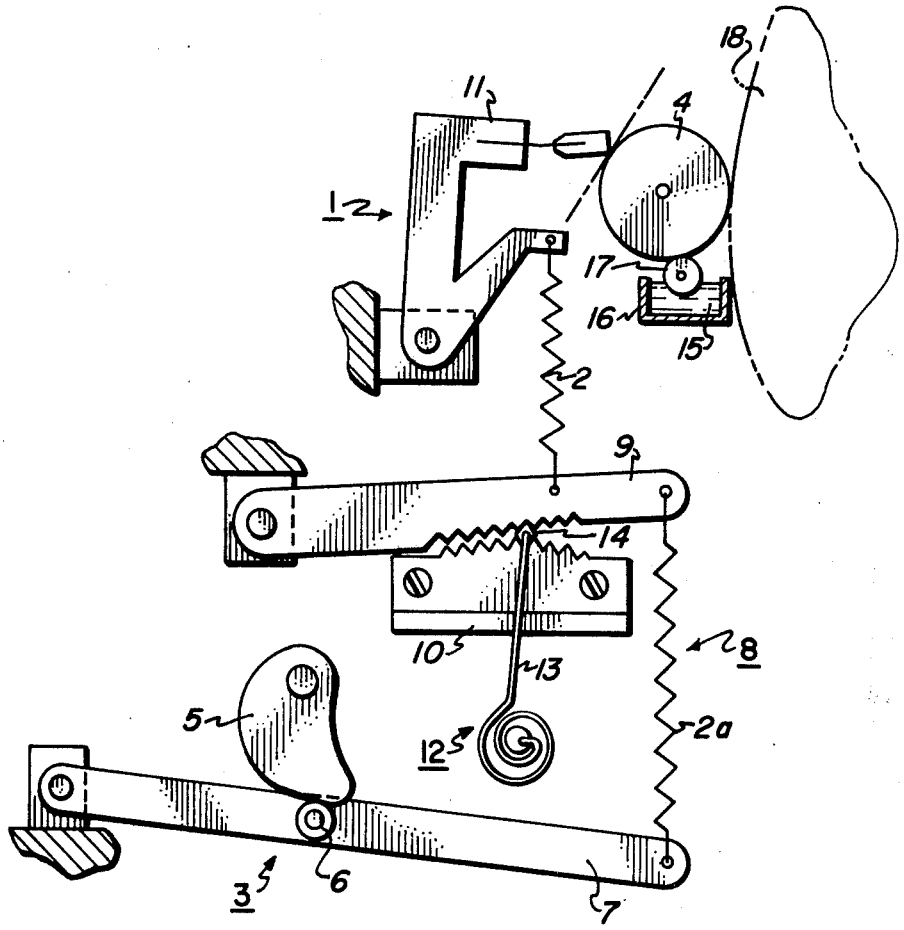
FIG. 2 is a schematic illustration of the embodiment of FIG. 1 shown in an engaged mode.

Referring now to FIG. 2, there is shown schematically and in cross-section the apparatus of FIG. 1 wherein doctor blade 11 of doctoring means 1 has been cammed onto the liquid developer applicator roller 4 at a fairly normal ambient temperature of about 20° C at which the bimetal strip 13 has moved the interposer 14 to a point about midway in its range of motion between the members of the set of jaws 8. In a working example, such a position of the interposer means 14 results in a pressure of the doctor blade 11 against the liquid developer applicator roller 4 of about 120 gm/cm which is suitable for the viscosity of about 800 cps which is normally observed in a mineral oil based liquid developer at 20° C.

Referring now to FIG. 3 there is shown an alternative means for moving the location of the interposer means 14 relative to the ambient temperature. In FIG. 3 the interposer means 14 is a bar supported by rigid arms 19 above a shaft 20. The shaft is connected at one end at a spring 21 positioned so as to provide resistance to the movement of the shaft 20. At the other end the shaft 20 is connected with a fluid torque converter 22 which is driven by a constant speed motor 23. The fluid in the fluid torque converter 22 may be selected to have the same temperature-viscosity characteristics as the liquid developer which is applied to the doctored surface. Alternatively, it may be the liquid developer.

As the ambient temperature changes, the viscosity of the fluid in the fluid torque converter 22 will change sufficiently to alter the output torque to the shaft 20 from the fluid torque converter 22. The torque is greater when the ambient temperature is lower and less when the ambient temperature is higher. The tension of the spring 21 is adjusted so that it resists the movement of the shaft 20 sufficiently to allow the movement of the interposer means 14 to suitable positions between the members of a set of jaws such as the set of jaws 8 in FIGS. 1 and 2.

Referring now to FIG. 4, there is shown yet another alternative apparatus for limiting the closing of the jaws of an apparatus such as that depicted in FIGS. 1 and 2. In the apparatus of FIG. 4, the ambient temperature is sensed by an electrical resistor 24 which controls the flow of current to a voice coil 25 positioned on a yoke 27 around the central "N" pole of a permanent magnet 26. The yoke 27 is supported by a diaphragm 27 which also supports an interposer means 14 which may be similar to those shown in FIGS. 1, 2 and 3. As the flow of current is modified by the electrical resistor 24, the voice coil 25 causes the yoke 27, diaphragm 38 and the interposer means to move. As shown in FIGS. 1 and 2, the interposer means 14 of FIG. 4 may be positioned between the members of a set of jaws so as to limit their closing.

While particular embodiments of the invention have been described above, it will be appreciated that various modifications such as the use of toothless jaws and interposer means of other shapes may be made by one skilled in the art without departing from the scope of the invention, as defined in the appended claims.

What is claimed is:

1. An apparatus for controlling the pressure of a doctoring means against a surface to be doctored responsive to changes in the ambient temperature, which comprises:

a. a surface to be doctored and doctoring means capable of engaging said surface;

b. a set of jaws wherein one of said jaws is stationary and another of said jaws is connected by extendable linkages to said doctoring means and to a means for repeatedly moving said jaws to a closed position, said movement being effective to bring the doctoring means into pressure contact with the surface sought to be doctored;

c. interposer means movably positioned between the stationary member and the movable member of the set of jaws for limiting the closing of the jaws responsive to ambient temperature such that the pressure of the doctoring means against the surface sought to be doctored is decreased at lower temperatures and increased at higher temperatures; and d. means for controlling the position of the interposer relative to ambient temperature.

2. The apparatus of claim 1, wherein the position of said interposer means is controlled relative to the ambient temperature of a bimetal strip.

3. The apparatus of claim 1, wherein the position of said interposer means is controlled relative to the ambient temperature by supporting a yoke and the interposer on a diaphragm, the yoke having a voice coil positioned thereon and positioned around a pole of a permanent magnet whereby the strength of an electric current modified by a temperature sensitive electrical resistor controls the flow of current to the voice coil and causes the yoke, diaphragm and interposer to move.

4. The apparatus of claim 1 wherein the doctoring means is an elastomer doctor blade.

5. The apparatus of claim 4 wherein the elastomer doctor blade is formed from neoprene.

6. The apparatus of claim 4 wherein the pressure of the doctor blade against the surface sought to be doctored ranges from about 27 gm/cm to about 310 gm/cm.

7. The apparatus of claim 1 wherein the surface sought to be doctored is a liquid developer applicator means.

8. The apparatus of claim 7 wherein the liquid developer applicator means comprises a roller having a surface pattern of lands and valleys.

9. The apparatus of claim 1 wherein the position of said interposer means is controlled relative to the ambient temperature by a fluid torque converter having a shaft and being driven by a constant speed motor, the shaft of the converter being connected to the interposer and to a spring positioned to provide resistance to the movement of the shaft, whereby the viscosity of fluid in the fluid torque converter changes with temperature and thereby alters the output torque to the shaft to cause corresponding movement in the interposer.

10. In an electrostatographic copying device in which an imaging surface is developed by contacting said imaging surface with a liquid developer applicator, said applicator having a surface pattern of lands and valleys, said valleys containing a liquid developer and said lands being doctored free from liquid developer by a doctoring means, the improvement which comprises:

a. an applicator having a surface pattern of lands and valleys and doctoring means capable of engaging said surface;

b. a set of jaws wherein one of said jaws is stationary and another of said jaws is connected by extendable linkages to said doctoring means and to a means for repeatedly moving said jaws to a closed position, said movement being effective to bring the doctoring means into pressure contact with the surface sought to be doctored, and c. interposer means movably positioned between the stationary member and the movable member of the set of jaws for limiting the closing of the jaws responsive to ambient temperature such that the pressure of the doctoring means against the surface sought to be doctored is decreased at lower temperatures and increased at higher temperatures; and d. means for controlling the position of the interposer relative to ambient temperature.

* * * * *